US005378876A

United States Patent [19]

Kitagawa

[11] Patent Number: 5,378,876

[45] Date of Patent: Jan. 3, 1995

[54] FAIL SAFE MICROWAVE OVEN

[75] Inventor: Yuichi Kitagawa, Daito, Japan

[73] Assignee: Funai Electric Co., Ltd., Daito, Japan

[21] Appl. No.: 111,841

[22] Filed: Aug. 25, 1993

[30] Foreign Application Priority Data

Oct. 28, 1992 [JP] Japan ..... 4-312934

[51] Int. Cl.[6] ..... H05B 6/70

[52] U.S. Cl. ..... 219/710; 219/716; 219/746; 219/750; 219/761; 219/723

[58] Field of Search ..... 219/10.55 F, 10.55 A, 219/10.55 R, 710, 716, 723, 736, 737, 746, 747, 750, 761, 695, 696

[56] References Cited

U.S. PATENT DOCUMENTS

| | | | |
|---|---|---|---|
| 2,498,720 | 2/1950 | Wild et al. | 219/736 |
| 3,437,777 | 4/1969 | Nagai et al. | 219/736 |
| 4,517,430 | 5/1985 | Slottag | 219/761 |
| 4,733,037 | 3/1988 | Nitta et al. | 219/10.55 F |
| 5,015,813 | 5/1991 | Yamada et al. | 219/10.55 F |
| 5,237,139 | 8/1993 | Berg et al. | 219/10.55 F |

*Primary Examiner*—Philip H. Leung

*Attorney, Agent, or Firm*—Lackenbach Siegel Marzullo Aronson & Greenspan

[57] ABSTRACT

The invention relates to a microwave oven which neither generates hot spots nor destroys a magnetron by shutting microwaves when there is no load to be heated. This microwave oven is constructed so that the impedances are matched when there is a load, and the impedances are unmatched when there is no load, by shifting the location of the opening of the cooking chamber from the center of the wave guide. When there is no load, as most of the microwaves are converted to standing waves and the pressing waves do not reach the cooking chamber, then it becomes possible to prevent dangers such as the abnormal irradiation of any part, the destruction of the chamber case owing to the occurrence of the heat spot, and the abnormal heat generation due to the leakage of the short waves.

5 Claims, 3 Drawing Sheets

FIG.2(a) IN CASES HAVING LOADS TO BE HEATED
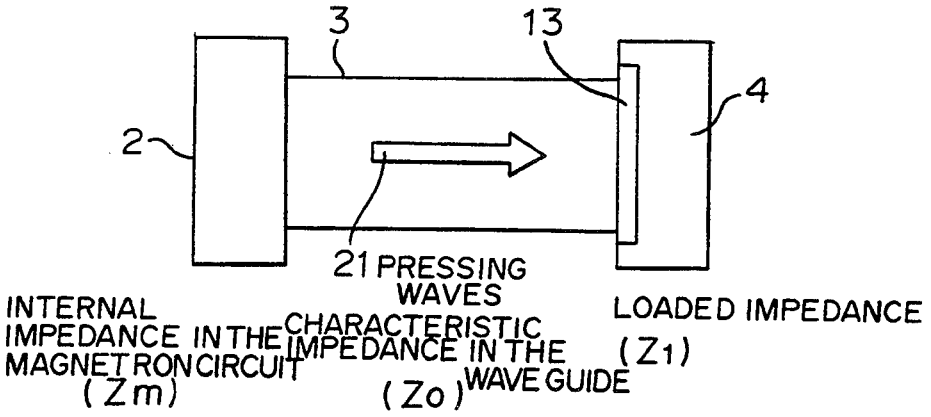
FIG.2(b) IN CASES HAVING NO LOADS
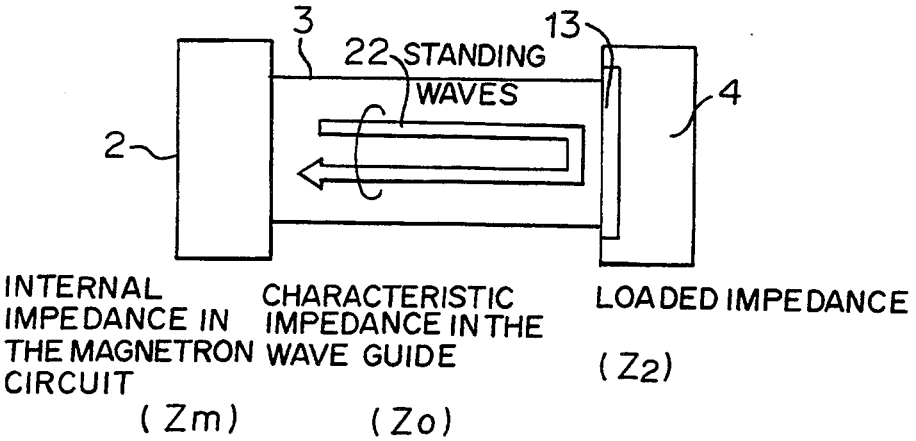

FAIL SAFE MICROWAVE OVEN

BACKGROUND OF THE INVENTION

The present invention relates to a microwave oven for cooking and thawing foods by applying irradiation of the microwaves generated in a magnetron.

When the microwave oven is operated without a heat load such as food or the like to absorb microwaves, or only a very small load is placed therein, local temperatures rise, in other words, a hot spot is generated therein, posing the danger of cracking a turntable, melting a holder of the table, melting and making a hole in a wall of the cooking chamber, or causing a fire due to short wave leakage or overheating.

Therefore, up to the present, by providing a pseudo-load, generally called a dummy load, in a wave guide or on the turntable as a light load, above-mentioned accidents such as an abnormal concentration of the short waves around the turntable and the holder of the table, and the occurrence of a hot spot on the wall of the cooking chamber have been prevented by the use of a dummy load even if the oven is used in an unloaded condition.

However, in this conventional construction, as the magnetron is driven for long time in a condition equivalent to being unloaded even if operated under a light load, it is hard to prevent over-loading of the magnetron and a drop in the service life of the magnetron. Further, while operating the oven under a light load, as the microwaves are absorbed by the dummy load, a drop in heating efficiency is also inevitable.

The present invention solves these problems or drawbacks, and the object thereof is to provide a microwave oven able to prevent any hot spot occurrence and the destruction of the magnetron by stopping the flow of the short waves into the cooking chamber when there is no load.

SUMMARY OF THE INVENTION

Briefly described, the microwave oven according to the present invention which introduces the microwaves generated in a magnetron into a cooking chamber through a wave guide and an opening of the cooking chamber for heating any load to be cooked by irradiating the microwaves, is characterized in that the opening of the cooking chamber is installed at a position shifted from the center of the wave guide by a predetermined amount so that impedances are matched when any load is in the cooking chamber, and the impedances are unmatched by reflecting the microwaves from the pocket shaped between the opening and the wave guide when the oven is operated with no load.

In other words, the oven is constructed so as to make the impedances match when any load is in the cooking chamber and to make the impedances unmatched when a load is not therein, by shifting the location of the opening from the center of the wave guide transmitting the microwaves generated in the magnetron, and in the pocket shaped between the opening and the wave guide, most microwaves change to reflecting waves and form a great deal of standing waves therein. As a result, the microwaves cannot reach the cooking chamber. It therefore becomes possible to prevent dangers such as abnormal irradiation of the turntable or the like, the destruction of the chamber case due to the generation of hot spots, and the abnormal heating of the even due to the leaking of microwaves.

Although the standing waves generated in the pocket of the wave guide return their reflected waves to the magnetron, and the electrodes of the magnetron are subjected to a high temperature, before the electrodes suffer from such high temperature, a thermostat controlling their temperature shuts off the electric current, and the destruction of the magnetron is avoided due to the high temperature.

By applying this construction, it is possible to eliminate inefficient parts such as the dummy load or the like, and an efficient and safe microwave oven can be realized.

BRIEF DESCRIPTION OF THE DRAWINGS

The foregoing and other objects and advantages of the present invention will become more readily apparent from the following detailed description in connection with the accompanying drawings in which:

FIGS. 2(*a*) and 2(*b*) are schematic drawings explaining the state of the impedance matching.

DETAILED DESCRIPTION OF THE INVENTION

Figure 1A:
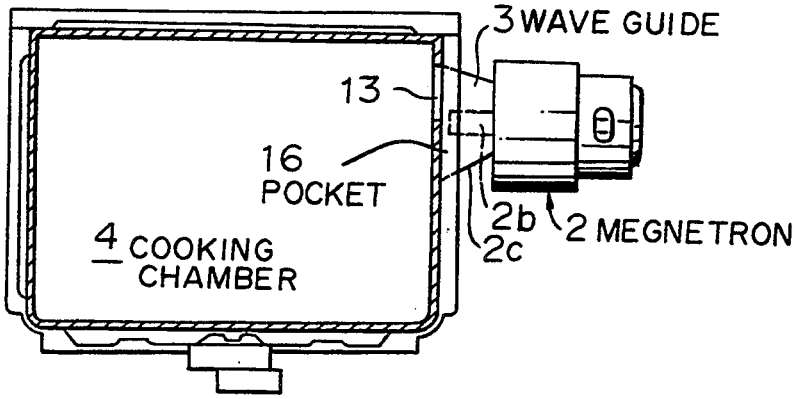
FIGS. 1(*a*), (1*b*) and 1(*c*) show a constructive view of the microwave oven according to the present invention.
Figure 1B:
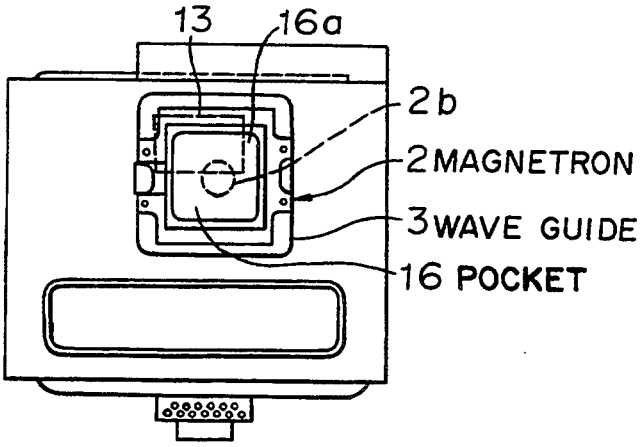
Figure 1C:
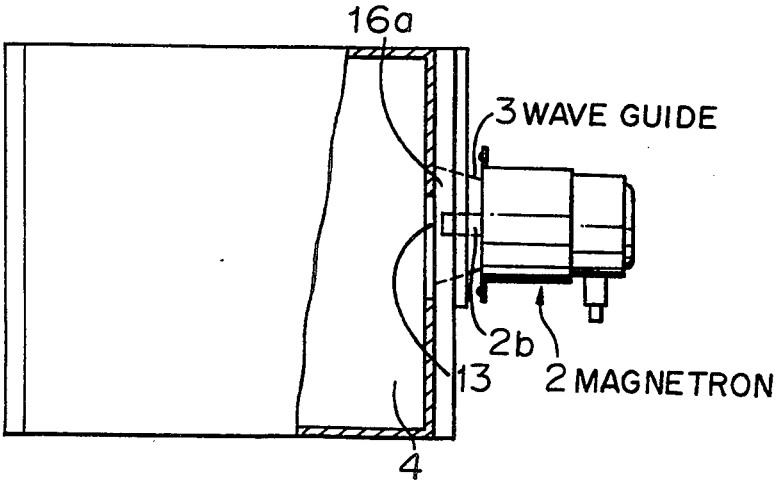

The preferred embodiment according to the present invention is described in detail with reference to the accompanying drawings in which the first sheet of the drawings show the constructive figures of the microwave oven, according to the present invention, and a front view, a right-handed side view and a top view thereof are shown in FIG. 1(*a*), FIG. 1(*b*) and FIG. 1(*c*), respectively.

Referring first to FIG. 1(*a*) showing the front view of the microwave oven, the microwaves generated in the magnetron 2 are introduced in the wave guide 3 through passing an outputting window. In this FIG. 1(*a*), the numeral 2*b* is an antenna transforming a coaxial output circuit into a wave guide transmitting circuit, and the numeral 2*c* is a shorting plate for matching the impedances in the position deviating from a quarter of wave length from the antenna 2*b*. Next, the microwaves are introduced into the cooking chamber 4 through passing an end portion of the wave guide equivalent to the entrance port 13 installed at the entrance of the cooking chamber 4. In this case, when a load such as food to be heated is placed in the cooking chamber 4, the progressive waves are favorably absorbed by the load, and such load is heated.

In the second figures, the impedance matching/unmatching conditions in the inventive microwave oven are shown. When a load is placed in the cooking chamber 4 as shown in FIG.2(*a*), as the internal impedance Zm in the magnetron circuit, the characteristic impedance Zo in the transmitting portion and the load impedance Z1 viewed from the opening 13 of the cooking chamber 4 are well matched, and the microwaves in the wave guide 3 are changed into the pressing waves 21.

On the other hand, when a load is not placed in the cooking chamber as shown in FIG. 2(*b*), the unloaded impedance Z2 viewed from the opening 13 is sharply different from the impedance Zm in the magnetron circuit and the impedance Zo in the wave guide 3, in spite of Zm and Zo being naturally well matched, and the microwaves in the wave guide 3 are then changed into the standing waves 22.

Accordingly, to realize the above-described conditions in the microwave oven, the location of the opening 13 through which the microwaves are transmitted in the cooking chamber 4 from the wave guide 3 is shifted from the center of the wave guide 3 so that the pocket 16 is shaped as much as the portion 16*a* as shown in FIG. 1(*a*), 1(*b*) and 1(*c*).

By applying this construction, it becomes possible to match all impedances existing in the oven if a load is placed in the cooking chamber 4, and to be unmatched where no load is placed therein.

The distance to be shifted of the opening 13 from the center of the wave guide 3 is about 1 cm. if the microwaves are about 2600 MHz. (Further, the direction to be shifted should be vertical against the high frequency electrical field in the wave guide 3.)

By adopting this construction, in the unloaded condition, as the microwave change in the large quantities of the standing waves according to the impedance change due to the enlarged portion 16*a* of the pocket 16 in the wave guide 3, most microwaves cannot reach the cooking chamber 4. Accordingly, it becomes possible to prevent accidents such as excessive irradiation against parts such as the turntable or the like, the destruction of the chamber case due to hot spots, and abnormal heating due to the leakage of the microwaves.

Figure 3:
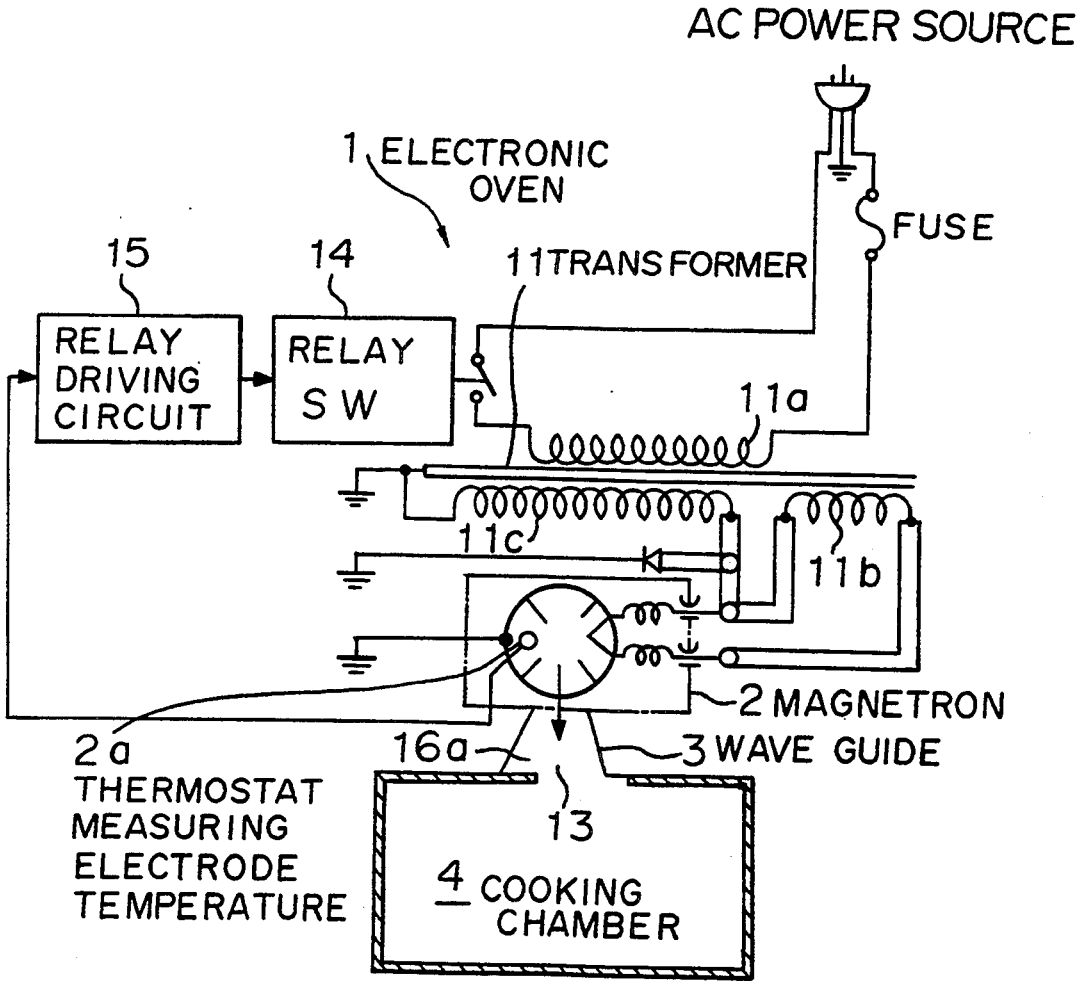
FIG. 3 is a circuit construction drawing of the microwave oven according to the present invention.

The circuit diagram of the oven is shown in FIG. 3.

In FIG. 3, numeral 1 is the microwave oven, numeral 2 is the magnetron, numeral 2*a* is the thermostat for measuring the temperature of the magnetron electrodes, numeral 3 is the wave guide, and numeral 4 is the cooking chamber.

Also, numeral 13 is the opening in which the microwaves enter the cooking chamber 4, the numeral 14 is a relay SW and the numeral 15 is a relay-driving circuit for driving the relay SW 14.

Further, the numeral 11 is a transformer, and the AC power source 12 is connected to a primary coil 11*a* through the relay SW 14, and a cathode heater of the magnetron 2 is connected to high voltage coils 11*c* and 11*b*.

Although the reflected waves in the microwaves return to the magnetron 2, (namely the standing waves are generated in the wave guide 3), the electrodes of the magnetron 2 and deteriorate as suffer with the temperature rises and may be damaged, but in the circuit shown in FIG. 3, as the thermostat 2*a* for measuring the temperature of the electrodes is activated before the electrodes reach abnormally high temperature and cut out and stop the electric current, the magnetron 2 is kept from being damaged or destroyed.

As best shown in FIG. 3, the thermostat 2*a* is constructed so as to cut stop the electric current through the relay-driving circuit 15 and the relay SW 14, but it may be constructed so as to directly cut the current by a self-thermostatic mechanism thereof.

From the foregoing description, it will be apparent that there has been provided a microwave oven enabling itself to prevent dangers such as abnormal irradiation of parts such as the turntable or the like, the destruction of the chamber wall due to hot spots, and abnormal temperature rises in the cooking chamber due to wave leaking, by constructing the oven so as to make impedances unmatched in the unloaded condition, and to make most microwaves convert to standing waves, and to prevent the microwaves from reaching the cooking chamber.

Also, when the standing waves are generated, the reflected waves return to the magnetron, and the electrodes thereof suffer from the temperature rise, but as the thermostat installed in electrodes shuts the electric current, it is possible to keep the magnetton from destructing.

Further, as this construction is able to eliminate inefficient parts such as dummy loads or the like, it becomes possible to realize an efficient and safe microwave oven.

What is claimed is:

1. A microwave oven having a cooking chamber, comprising:

a magnetron for generating microwaves in an electrical circuit powered by an AC source, a thermostat associated with said magnetron and adapted to shut off said AC source when said thermostat detects a predetermined high temperature of said magnetron, a cooking chamber opening, associated with a wave guide having a center, disposed so as to radiate said microwaves upon a load adapted to be placed for heating in said cooking chamber, and to capture microwaves reflected back toward said magnetron when there is no load in said cooking chamber, and said thermostat causing said magnetron to cease generating microwaves upon reflection of said microwaves back and sensing an increase in the temperature of said magnetron, and wherein said heating being performed by microwave radiation of the load in the cooking chamber, and said microwaves generated by said magnetron being routed into said cooking chamber via said wave guide and said cooking chamber opening.

2. The microwave oven according to claim 1, wherein the location of said cooking chamber opening is shifted and offset from the center of said wave guide by a predetermined amount, in order to make the impedances existing in said oven match when a load to be heated is placed in said cooking chamber, and to cause a mismatch of said impedances when no load is placed therein by applying reflected waves generated in a pocket between said shifted opening and said wave guide, thereby stopping tho flow of short waves into said cooking chamber.

3. The microwave oven according to claim 1, wherein said cooking chamber opening is rectangular in shape, and said opening is shifted from the center of said wave guide by about 1 cm where the microwaves are about 2600 MHz.

4. The microwave oven according to claim 3 wherein said shift is in a vertical direction against the high frequency electrical field in said wave guide.

5. The microwave oven according to claim 1, wherein said thermostat measuring the temperature of said magnetron, and being connected to said electrical circuit via a relay driven switch.

* * * * *